US005720557A

United States Patent [19]

Simonsen

[11] Patent Number: 5,720,557

[45] Date of Patent: Feb. 24, 1998

[54] TACK AND TIE BAGS

[75] Inventor: Steven H. Simonsen, Neenah, Wis.

[73] Assignee: Reynolds Consumer Products, Inc., Appleton, Wis.

[21] Appl. No.: 811,617

[22] Filed: Mar. 5, 1997

Related U.S. Application Data

[63] Continuation-in-part of Ser. No. 609,196, Mar. 1, 1996, abandoned.

[51] Int. Cl.[6] ..... B65D 33/24

[52] U.S. Cl. ..... 383/61; 383/63; 383/77; 383/86

[58] Field of Search ..... 383/61, 77, 63, 383/84, 86, 8

[56] References Cited

U.S. PATENT DOCUMENTS

| | | | |
|---|---|---|---|
| 1,128,192 | 2/1915 | Smith | 383/62 |
| 3,052,399 | 9/1962 | Brown | 383/61 |
| 4,008,851 | 2/1977 | Hirsch | 229/62 |
| 4,312,392 | 1/1982 | Sekiguchi | 383/8 |
| 4,445,230 | 4/1984 | Spadaro | 383/7 |
| 4,584,201 | 4/1986 | Boston | 426/106 |
| 4,706,297 | 11/1987 | Ausnit | 383/63 |
| 4,753,538 | 6/1988 | Jordá | 383/8 |
| 4,764,029 | 8/1988 | Abblett | 383/104 |
| 4,890,736 | 1/1990 | Greyvenstein | 206/390 |
| 4,906,108 | 3/1990 | Herrington et al. | 383/71 |
| 5,188,461 | 2/1993 | Sorensen | 383/63 |
| 5,282,686 | 2/1994 | Haber | 383/77 |
| 5,415,475 | 5/1995 | Sandy | 383/8 |
| 5,568,979 | 10/1996 | Fifer et al. | 383/8 |

FOREIGN PATENT DOCUMENTS

| | | |
|---|---|---|
| 2-85159 | 3/1990 | Japan . |

*Primary Examiner*—Stephen P. Garbe
*Attorney, Agent, or Firm*—Alan T. McDonald

[57] ABSTRACT

The present invention relates to polymeric packages and, more particularly, relates to polymeric packages having both integrally formed flanges for tying and a second integrally formed closure mechanism such as an adhesive based closure element.

13 Claims, 3 Drawing Sheets

TACK AND TIE BAGS

CROSS-REFERENCE TO RELATED APPLICATIONS

This is a continuation-in-part of U.S. Application Ser. No. 08/609196, filed Mar. 1, 1996, now abandoned.

FIELD OF THE INVENTION

The present invention relates to polymeric packages and, more particularly, relates to polymeric packages having both integrally formed flanges for tying and a second integrally formed or added in-line closure mechanism such as an adhesive based closure element.

BACKGROUND OF THE INVENTION

Sealable polymeric packages, such as garbage bags, are a common household item. These bags are typically formed from a continuous tube of plastic that is cut and heat-sealed at appropriate intervals to form individual bags. The bags come to the consumer in the form of a roll or folded and stacked. The bags on a roll can form a continuous roll and are usually referred to as a perforated roll or can be in the form of interleved bags folded and stacked for one-at-a-time dispensing. In the perforated roll configuration, one end of the bag, the bottom, is heat-sealed closed and connected to its neighboring bag via a perforated detachable seal. When formed as a continuous roll, the bags are formed as alternate pairs, i.e., a bottom seal is formed for two adjacent bags followed by a top seal for the second of the adjacent bags and a third bag, followed by another bottom seal for the third and fourth bags, and so on.

In order to close a typical polymeric bag after it has been filled by the consumer, the sidewalls adjacent the open end of the bag are gathered and tied into a knot or secured using a separate tie member supplied by the vendor of the bags. Tie members typically include paper coated flexible wires, rubber bands, or strips of plastic having a locking mechanism to provide a means to pull tight and securely fasten the neck of the bag. The need for separate tie members, however, adds an additional cost factor for the manufacturer, and ultimately, the consumer. In addition, separate tie members are easily lost and hence a nuisance for the consumer. The present invention seeks to overcome these problems by providing a polymeric package having integrally formed flanges for tying as well as a second integrally formed closure mechanism. Such bags are capable of being formed from an endless tube of plastic and thus can be produced efficiently and cheaply.

SUMMARY OF THE INVENTION

The present invention provides an easily manufactured, consumer-friendly, polymeric bag which incorporates a two-tiered closure arrangement. The closure arrangement is integral to the bag itself thereby dispensing with the need for separately included closure means.

In one embodiment, the invention provides a polymeric bag having a tube-like element forming sidewalls of the bag, the tube-like element having a sealed bottom edge and a top edge; a first closure means including first and second flanges connected to the top edge of the sidewalls of the bag and positioned so as to be tieable to each other; and a second closure means, different from the first closure means, and positioned between the flanges of the first closure means.

In a preferred embodiment, the first and second flanges are positioned directly opposite each other on the tube-like element of the bag.

Most preferably, the flanges are integrally formed with the tube-like element of the bag.

The second closure means can take a variety of forms including an adhesive element, reclosable zipper, and even VELCRO® made by Velcro U.S.A., Inc. In the case where the second closure means consists of an adhesive element, it is preferably in the form of a foundation strip having first and second sides, said first side having a first adhesive attached thereto, said second side having a second adhesive attached thereto and a protective strip temporarily connected to said second adhesive, said first adhesive attaching said first side to said tube-like element of said bag, wherein said protective strip is stripped away from said foundation strip to expose said second adhesive. The second adhesive is preferably glue.

In another embodiment, the present invention provides a method of closing a polymeric bag having a tube-like element having a sealed bottom edge; a first closure means consisting of first and second flanges, said flanges connected to said top edge of said bag and positioned so as to be tieable to each other; and a second closure means, different from said first closure means; the method comprising: first, aligning the sidewalls of the tube-like element of the bag so that the first and second flanges are positioned directly across from each other and the second closure means is positioned so as to facilitate contact with said opposite side of the tube-like element of the bag; second, bringing together said opposing sidewalls of the tube-like element so as to engage the second closure means; and last, tying said first and second flanges together.

In a preferred embodiment, the second closure means consists of an adhesive element. The adhesive element is preferably in the form of a foundation strip having first and second sides, said first side having a first adhesive attached thereto, said second side having a second adhesive attached thereto and a protective strip temporarily connected to said second adhesive, said first adhesive attaching said first side to said tube-like element of said bag, wherein said protective strip is stripped away from said foundation strip to expose said second adhesive.

In yet another preferred embodiment, the present invention provides a polymeric bag having a tube-like element forming side walls of said bag, said tube-like element having a bottom edge and a top edge wherein said bottom edge is sealed; first and second flanges connected to said tube-like element; and an adhesive element connected to said tube-like element located between said first and second flanges. The adhesive element is most preferably in the form of a foundation strip attached to the tube-like element onto which is coated adhesive which can be exposed by removing a protective strip.

In a most preferred embodiment, the first and second flanges are positioned directly across from each other and are integrally formed with the sidewalls of the bag. The most preferred shape of the flanges is a parabolic shape that blends smoothly into the tube-like element of the bag.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENTS

While the invention will be described in connection with certain preferred embodiments, it is not intended to limit the invention to the specific exemplary embodiments. On the contrary, it is intended to cover all alternatives, modifications, and equivalents as may be included within the spirit and scope of the invention as defined by the appended claims.

Figure 1:
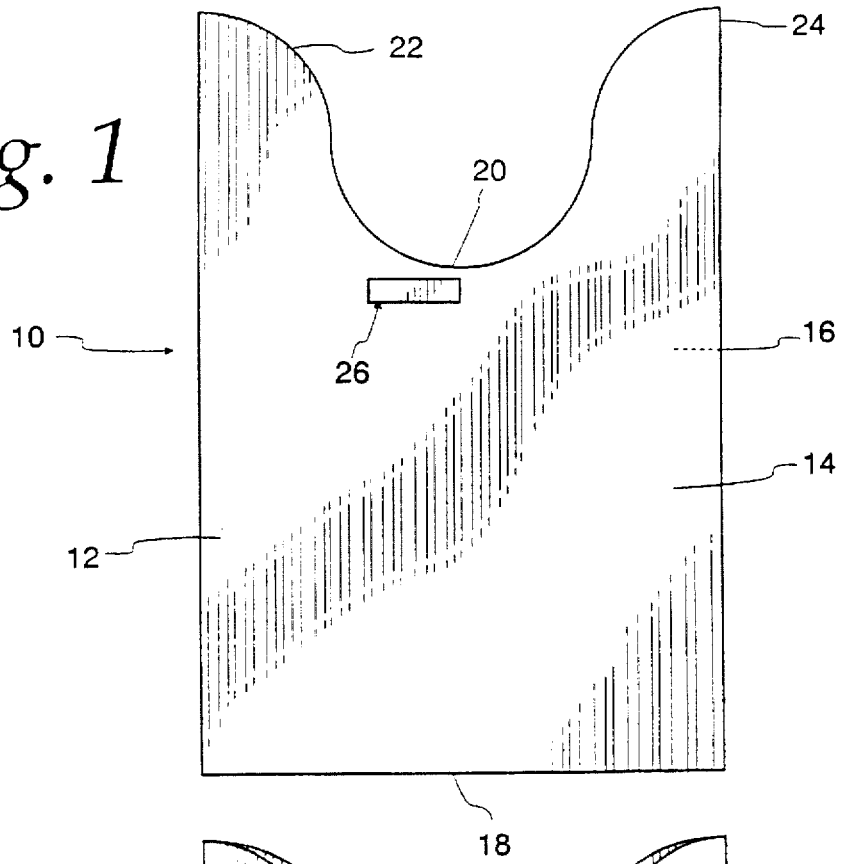
FIG. 1 is a plan view of an empty, unsealed polymeric package including two tieable flanges and an adhesive element including a foundation strip covered by its protective strip.

Turning now to the drawings, FIG. 1 illustrates a polymeric bag or package 10 including a tube-like element 12 forming sidewalls 14, 16 of the bag. The tube-like element 12 has a sealed bottom edge 18 which forms the bottom of the bag and an open top edge 20. The package 10 also includes a first closure assembly defined by first and second flanges 22, 24 which are integrally formed with the tube-like element 12 of the package 10, and a second closure assembly defined by an adhesive element 26 on sidewall 14.

Figure 2:
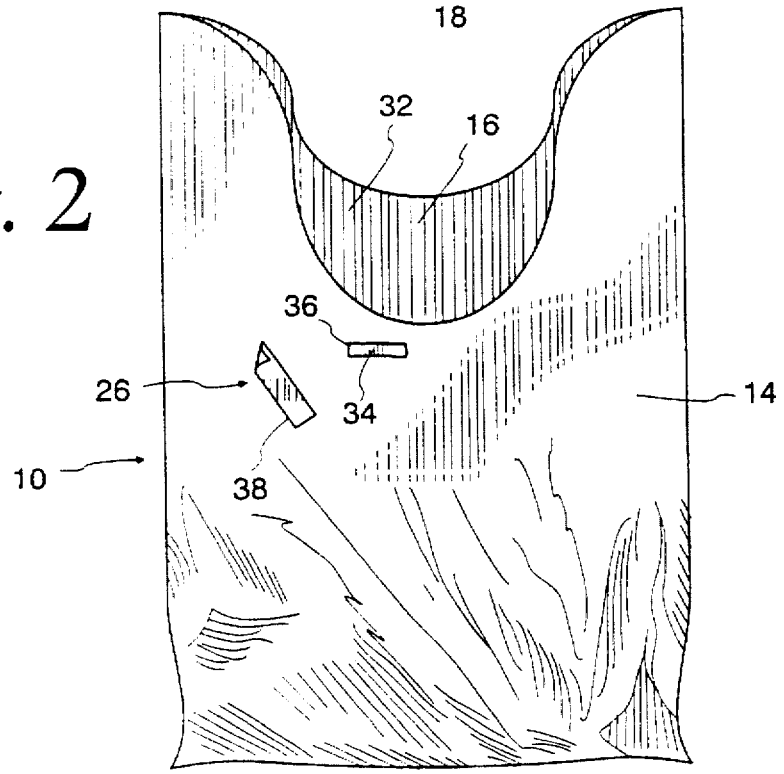
FIG. 2 is a plan view of a full, unsealed polymeric package including two tieable flanges and an adhesive element wherein the foundation strip has its protective strip removed.

FIG. 2 illustrates a polymeric package 10 having contents therein. One can clearly see the opening 32 at the top edge 20 (see FIG. 1) of the package 10. The opening 32 is formed when the sidewalls 14, 16 forming the tube-like element 12 are pulled apart. As illustrated in FIG. 2, the adhesive element 26 includes a foundation strip 36 secured to sidewall 14 on which adhesive 34 is applied. A protective strip 38 (illustrated as separated from the adhesive 34) is placed on the adhesive 34 until the bag 10 is to be closed. The adhesive 34 is exposed by removal of the protective strip 38.

Figure 3:
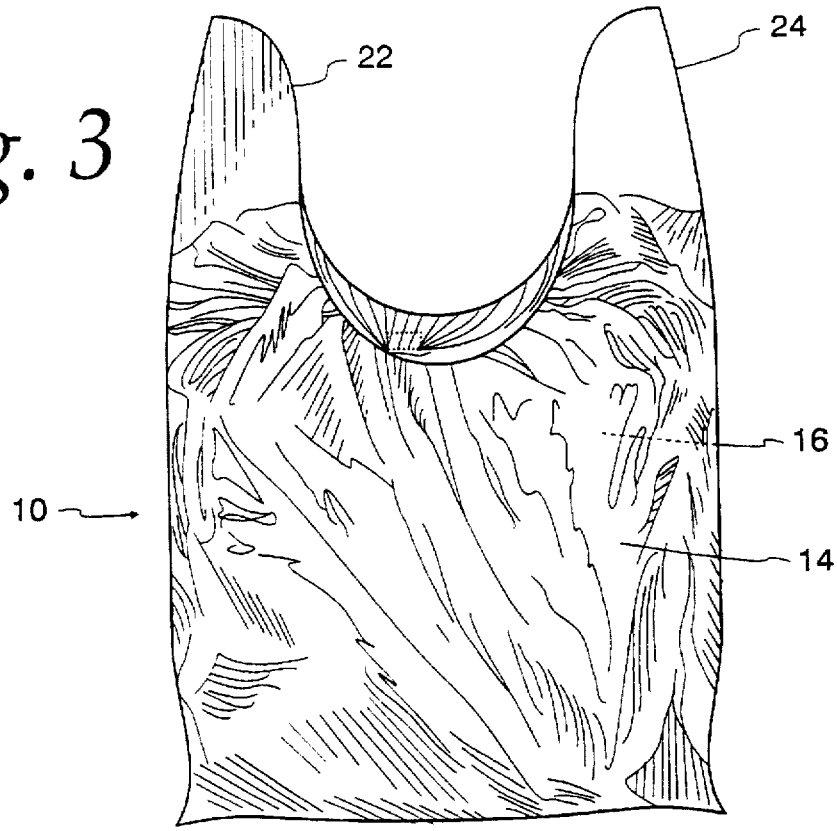
FIG. 3 is a plan view of a full polymeric package wherein the top edge of the rear sidewall of the package is sealed to the top edge of the front sidewall of the package utilizing the adhesive coated foundation strip.

FIG. 3 illustrates a polymeric package 10 in which the top portion of sidewall 16 has been pulled forward and stuck to the exposed adhesive 34 on the foundation strip 36 on sidewall 16.

Figure 4:
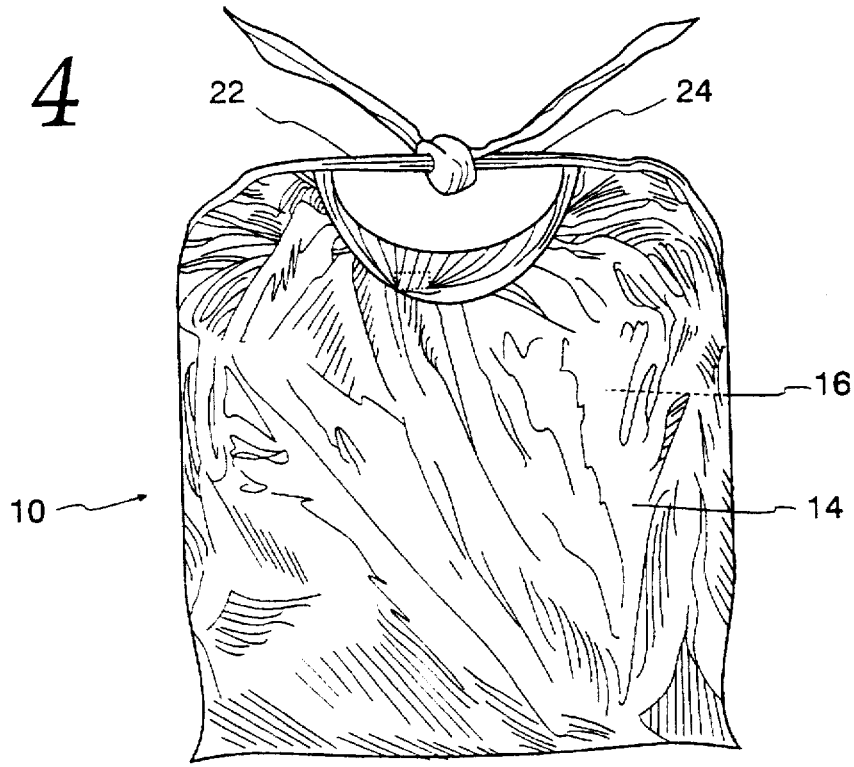
FIG. 4 is a plan view of a package similar to that depicted in FIG. 3 and further where the opposing flanges are tied.

FIG. 4 illustrates a polymeric package 10 in which the top portion of sidewall 16 has been pulled forward and stuck to the exposed adhesive 34 on the foundation strip on sidewall 16 and further in which the first and second flanges 22, 24 have been tied together.

FIGS. 2–4 illustrate the sequence of events involved in closing the polymeric package of the preferred embodiment. After the polymeric bag or package is ready to be sealed, the consumer first removes the protective strip 38 from the foundation strip 36 to expose the adhesive 34. Next the consumer aligns the sidewalls 14, 16 of the package 10 and grabs the top portion of sidewall 16 of the package and presses it onto the adhesive 34 located on the opposite sidewall 14 of the package 10. Next, the consumer ties the first and second flanges 22, 24 together.

Figure 5:
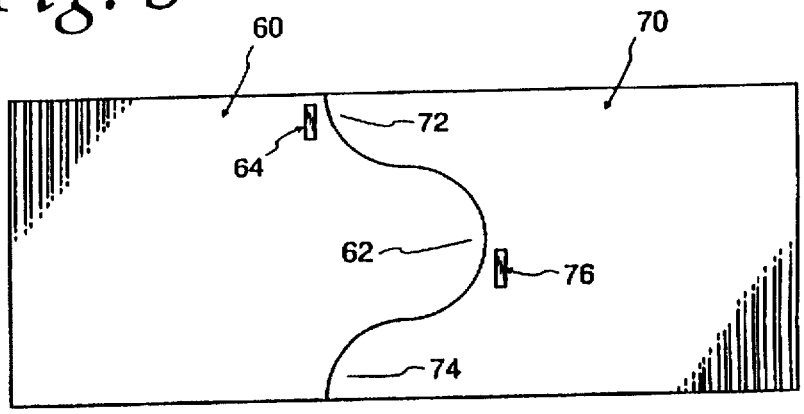
FIG. 5 is a top view of a section of a consumer roll of packages depicting two joined polymeric packages.

FIG. 5 illustrates a section of two neighboring polymeric bags or packages 60, 70 from a continuous roll of such packages. FIG. 5 shows the orientation of neighboring polymeric packages 60, 70 on the roll. Viewing the unrolled packages from the top, one can see the first and second flanges 72, 74 and adhesive element 76 of package 70. On package 60 only one flange 62 can be seen in addition to an adhesive element 64. The other flange is located on the backside of the tubular roll.

As discussed, the second closure means can also be in the form of a reclosable zipper, VELCRO® made by Velcro, U.S.A., Inc. or any other closure means differing from the tying flanges of the first closure means. In addition, the adhesive can be directly applied to a sidewall of the polymeric package (without the need of a foundation strip) and covered with a protective strip.

Figure 6:
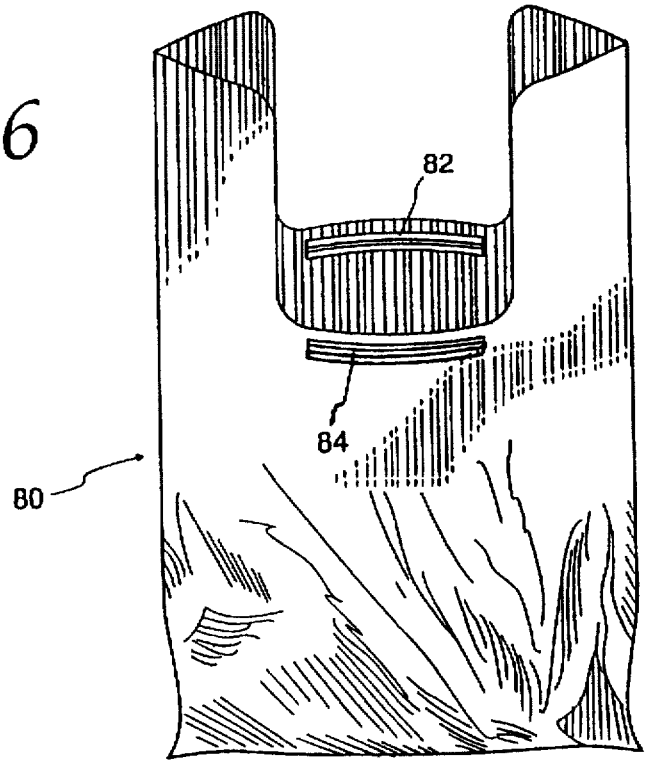
FIG. 6 is a plan view of a polymeric package having two interlocking closure profiles making up a reclosable zipper.

In the case where the second closure means is a reclosable zipper, as is shown in FIG. 6, the closure means consists of two interlocking closure profiles 82, 84. Generally, one of the profiles has a pair of locking members integrally formed with that profile (the female closure profile) and the second profile has an expanded head as its single locking member integrally formed with that second profile (the male closure profile).

The pair of locking members 82, 84 are disposed opposite the single locking member and are spaced by a sufficient distance that the expanded head of the single locking member is releasably engageable between the pair of locking members and can interlock with the single male locking member in a snapping action caused by bringing the hooks of the pair of locking members past the expanded head of the locking member.

Locking member 82 is positioned on the inside of rear sidewall 16 and locking member 84 is positioned on the outside of front sidewall 14 to permit the upper portion of rear sidewall 16 to be pulled over the upper portion of front sidewall 14 to engage the locking members 82, 84.

Composition Of Polymeric Bag And Adhesive

A prototypical one-layer polymeric bag of the present invention is preferably composed of linear low density polyethylene. Specifically, a formulation composed of linear low density butene, hexene or octene or a terpolymer or mixtures thereof may be used.

Polyethylene compositions other than linear low density polyethylene may optionally be blended with the linear low density polyethylene to lend various strength characteristics to the polymeric bag. For instance, a small amount of low density polyethylene, less than 10%, may be blended in to afford additional bubble stability and melt strength. Alternatively, a small amount of high density polyethylene, 5–10%, may be blended with the linear low density polyethylene to lend stiffness to the finished polymeric bag.

The polymeric bag of the present invention may also be composed primarily of high density polyethylene with approximately 10–15% linear low density polyethylene blended in to maintain appropriate heat seal characteristics.

One skilled in the art will recognize that the polyethylene bags of the present invention may also be composed of various amounts of certain novel polymers such as ultra linear low density polyethylene, superhexene, or metallocene based polymers.

The polymeric bags of the present invention can have multiple layers. Such multi-layered bags are manufactured through coextrusion. Thus, one skilled in the art can design and coextrude multi-layered polymeric bags which will incorporate the various properties inherent in differing polyethylene compositions. For instance, a polymeric bag may be coextruded so as to incorporate a layer of linear low density polyethylene and a layer of high density polyethylene. Such a bag will exhibit the high tear resistance characteristic of linear low density polyethylene and the high puncture resistance of high density polyethylene.

It is further possible to incorporate pigments and/or metallic components into or on the layer or layers of the polymeric bags of the instant invention.

Appropriate compositions for the adhesive present in the adhesive based closure means of the present invention include any one of a number of glue formulations appropriate for sticking to plastic. Such glue formulations are well known to those skilled in the art. Appropriate compositions for the foundation strip include various paper, cardboard and plastic materials. The protective strip which must be stripped away from the foundation strip to expose the plastic is typically made of paper.

Method Of Manufacture

The polymeric packages or bags of the instant invention are manufactured using conventional extrusion and heat sealing techniques. In particular, a hollow tube of polymeric material making up adjoining polymeric packages are extruded through a die plate fed by one or more extruders. As is well-known in the art, the die plate is configured to shape the molten materials into the distinct tubular shape of the polymeric packages of the instant invention.

After extruding the hollow tube making up the sidewalls of the polymeric package, the second closure means is affixed to each distinct package. If the second closure means is the described adhesive element, the foundation strip, adhesive, and attached protective strip are affixed to the package by permanently gluing the foundation strip to the package so that the protective strip is farthest from the package. In the case of a second closure means comprising a reclosable zipper, the interlocking closure profiles making up the zipper can be affixed to the polymeric package by techniques well known in the art. Finally, the bottom of each package is heat sealed with a heat seal bar and perforated with a cutting knife and the top end of each package is perforated. This dual perforation will allow the consumer to easily detach adjoining packages.

While the present invention has been described with reference to one or more particular embodiments, those skilled in the art will recognize that many changes may be made thereto without departing from the spirit and scope of the present invention.

I claim:

1. A polymeric bag, comprising:

a tube-like element forming first and second sidewalls of said bag, said tube-like element having a bottom edge and a top edge wherein said bottom edge is sealed;

a first closure means including first and second flanges, said flanges connected to said top edge of said tube-like element and positioned so as to be tieable to each other; and a second closure means, different from said first closure means, disposed on at least the first of said sidewalls of said tube-like element between said first and second flanges and below said top edge to permit an upper portion of said second sidewall to be pulled over an upper portion of said first sidewall and attached to said first sidewall through said second closure means.

2. The polymeric bag of claim 1, wherein said first and second flanges are positioned directly opposite each other on said tube-like element of said bag.

3. The polymeric bag of claim 1, wherein said first and second flanges are integrally formed with said tube-like element of said bag.

4. The polymeric bag of claim 1, wherein said second closure means includes a foundation strip having first and second sides, said first side having a first adhesive 4 attached thereto, said second side having a second adhesive attached thereto and a protective strip removably secured to said second adhesive, said first adhesive attaching said first side to said tube-like element of said bag.

5. The polymeric bag of claim 4, wherein said first and second adhesives are the same material.

6. The polymeric bag of claim 4, wherein said second adhesive is glue.

7. The polymeric bag of claim 1, wherein said second closure means comprises a reclosable zipper, said reclosable zipper including first and second base strips attached to said first and second sidewalls of said tube-like element of said bag below said top edge respectively, said first and second base strips including respective first and second interlocking closure profiles extending from said respective first and second base strips, said first and second base strips positioned on said tube-like element such that said first and second interlocking closure profiles can effectively interlock and prevent spillage from said polymeric bag.

8. The polymeric bag of claim 7, wherein said first and second base strips are positioned on said tube-like element directly across from each other and midway between said first and second flanges of said first closure means.

9. A method of closing a polymeric bag including a tube like element forming first and second sidewalls of said bag, said tube-like element having a bottom edge and a top edge wherein said bottom edge is sealed; a first closure means including first and second flanges, said flanges connected to said top edge of said tube-like element and positioned so as to be tieable to each other; and a second closure means, different from said first closure means, disposed on at least the first of said sidewalls of said tube-like element between said first and second flanges and below said top edge; said method comprising:

a) aligning the sidewalls of the tube-like element of said bag such that said second closure means is positioned so as to facilitate contact between said sidewalls of said tube-like element of said bag;

b) pulling an upper portion of said second sidewall over an upper portion of said first sidewall so as to engage said second closure means; and c) tying said first and second flanges together.

10. The method of claim 9, further including the step of preparing said second closure means to be attached to said upper portion of said second sidewall.

11. The method of claim 10, wherein said second closure means includes a foundation strip having first and second sides, said first side having a first adhesive attached thereto, said second side having a second adhesive attached thereto and a protective strip temporarily connected to said second adhesive, said first adhesive attaching said first side to said tube-like element of said bag, wherein said protective strip is stripped away from said foundation strip to expose said second adhesive and said preparation of said second closure means comprises removing said protective strip from said foundation strip to expose said adhesive on said second side of said foundation strip.

12. The polymeric bag of claim 1, wherein said second closure means is an adhesive means.

13. The polymeric bag of claim 12, wherein said adhesive means is positioned 90° from each of said flanges.

* * * * *